US009845665B2

(12) United States Patent
De Clute-Melancon

(10) Patent No.: US 9,845,665 B2
(45) Date of Patent: Dec. 19, 2017

(54) LINER DRILLING USING RETRIEVABLE DIRECTIONAL BOTTOM-HOLE ASSEMBLY

(71) Applicant: Halliburton Energy Services, Inc., Houston, TX (US)

(72) Inventor: Daniel A. De Clute-Melancon, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/909,127

(22) PCT Filed: Oct. 8, 2014

(86) PCT No.: PCT/US2014/059712
§ 371 (c)(1),
(2) Date: Jan. 31, 2016

(87) PCT Pub. No.: WO2016/057032
PCT Pub. Date: Apr. 14, 2016

(65) Prior Publication Data

US 2016/0312586 A1 Oct. 27, 2016

(51) Int. Cl.
*E21B 7/20* (2006.01)
*E21B 43/10* (2006.01)
(Continued)

(52) U.S. Cl.
CPC ..... *E21B 43/103* (2013.01); *E21B 7/04* (2013.01); *E21B 7/20* (2013.01); *E21B 7/203* (2013.01);
(Continued)

(58) Field of Classification Search
CPC ..... E21B 43/103; E21B 33/12; E21B 33/14; E21B 33/16; E21B 7/04; E21B 7/20;
(Continued)

(56) References Cited

U.S. PATENT DOCUMENTS 3,457,992 A * 7/1969 Brown ..... E21B 33/043 166/335
3,628,822 A * 12/1971 Bostock ..... E21B 31/18 294/86.18
(Continued)

FOREIGN PATENT DOCUMENTS

EP 1712732 B1 7/2009

OTHER PUBLICATIONS

PCT International Search Report dated Jul. 8, 2015.
PCT Written Opinion dated Jul. 8, 2015.

*Primary Examiner* — Robert E Fuller
*Assistant Examiner* — David Carroll
(74) *Attorney, Agent, or Firm* — Locke Lord LLP

(57) ABSTRACT

In one embodiment, there is provided a system for liner drilling in a wellbore that includes a drill bit, a mud motor, a reamer, a drill pipe work string including an expandable liner hanger running tool, and a thruster coupled to an expandable liner hanger and liner. A release pin may be provided in the expandable liner hanger running tool that can be sheared to de-couple the expandable liner hanger from the expandable liner hanger running tool allowing the drill pipe work string to be removed from the borehole while the liner remains in place. A latch coupling is also provided for coupling the expandable liner hanger running tool to the expandable liner hanger when the drill pipe work string is tripped back into the borehole so the liner drilling can be performed using the thruster until the thruster is at full stroke.

13 Claims, 14 Drawing Sheets

(51) Int. Cl.

| | |
|---|---|
| ***E21B 33/14*** | (2006.01) |
| ***E21B 33/16*** | (2006.01) |
| ***E21B 7/04*** | (2006.01) |
| ***E21B 33/12*** | (2006.01) |

(52) U.S. Cl.
CPC ..... *E21B 33/12* (2013.01); *E21B 33/14* (2013.01); *E21B 33/16* (2013.01)

(58) Field of Classification Search
CPC ..... E21B 7/203; E21B 7/208; E21B 7/265; E21B 7/28
See application file for complete search history.

(56) References Cited

U.S. PATENT DOCUMENTS

| | | | | |
|---|---|---|---|---|
| 7,784,552 | B2 | 8/2010 | Brouse | |
| 7,926,520 | B2 | 4/2011 | Eriksen et al. | |
| 7,926,578 | B2 | 4/2011 | Moffitt et al. | |
| 8,132,619 | B2 | 3/2012 | Smith, Jr. et al. | |
| 8,276,689 | B2 | 10/2012 | Giroux et al. | |
| 2002/0074130 | A1* | 6/2002 | Cook | E21B 17/08 166/378 |
| 2002/0195249 | A1* | 12/2002 | Murray | E21B 29/06 166/313 |
| 2004/0221997 | A1* | 11/2004 | Giroux | E21B 4/02 166/380 |
| 2008/0257560 | A1* | 10/2008 | Brisco | E21B 34/14 166/377 |
| 2009/0090508 | A1 | 4/2009 | Brouse | |
| 2010/0096123 | A1 | 4/2010 | Hueston et al. | |
| 2011/0036594 | A1 | 2/2011 | Yokley et al. | |

* cited by examiner

DLD Drilling New Hole

DLD Bit Trip

DLD Bit Tip

DLD Cementing

DLD Cementing

LINER DRILLING USING RETRIEVABLE DIRECTIONAL BOTTOM-HOLE ASSEMBLY

TECHNICAL FIELD

The embodiments disclosed herein relate generally to methods and systems for oil field directional drilling. In particular, the embodiments relate to a method for directional liner drilling and cementing using a retrievable bottom-hole assembly.

BACKGROUND

A liner is basically a casing string that does not extend to the top of the wellbore, but instead is suspended from inside the bottom of the previous casing string. In directional liner drilling, the bore hole is drilled with the liner located above the bottom hole drilling assembly. The liner effectively becomes part of the drill string. Drilling through thousands of feet of subterranean formation may dull the drill bit, which requires the bottom hole drilling assembly to be brought to the surface to change the drill bit or perform other maintenance. When the bottom-hole assembly is tripped out of the bore hole to retrieve the drill bit, the liner is typically pulled out with the bottom-hole assembly. Accordingly, what is needed are systems and methods for retrieving the bottom-hole assembly to the surface while leaving the liner down hole.

DETAILED DESCRIPTION OF DISCLOSED EMBODIMENTS

Figure 1:
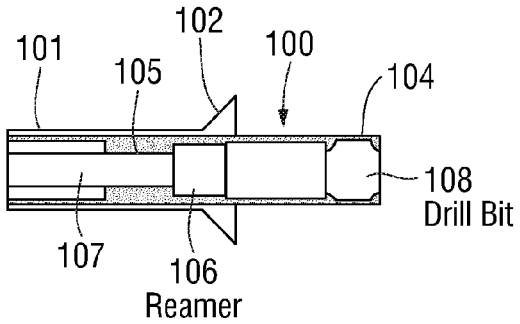
FIG. 1 is a schematic diagram illustrating a directional liner drilling operation according to one or more embodiments of the disclosure.

As an initial matter, it will be appreciated that the development of an actual, real commercial application incorporating aspects of the disclosed embodiments will require many implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

As mentioned above, the embodiments disclosed herein relate to directional liner drilling and cementing using a retrievable bottom-hole assembly. According to one or more embodiments, a method is provided that allows the running of a liner into a borehole while directionally drilling a new borehole. The liner may be placed downhole and left in position while the directional drilling bottom-hole assembly is brought to the surface to change the drill bit or perform other maintenance. The operator may then re-enter the liner with the bottom-hole assembly and subsequently re-attach the bottom-hole assembly to the liner and continue drilling the borehole. Leaving the liner in place at the bottom of the borehole helps protect that portion of the borehole from collapsing or otherwise filling up with debris or formation material that may prevent or make it more difficult to properly case off that portion of the borehole.

In one implementation, a drill pipe work string is attached to a liner hanger and a liner hanger running tool. The liner hanger may be an expandable liner hanger in some implementations and may also include a packer in some implementations, while the liner hanger running tool may be an expandable liner hanger running tool in some implementations, without departing from the scope of the disclosed embodiments. A tailpipe, an inner string below the liner hanger running tool, may be attached below, or downhole of, the expandable liner hanger and packer running tool. The drill pipe work string may also include a thruster tool and a directional drilling assembly. The liner is attached to the expandable liner hanger and packer. In one embodiment, the liner or any suitable liner tubular or tubular system may be continuous and made from any suitable materials such as metals, plastics, composites, etc. In various embodiments the liner may be segmented or contain sliding sleeve subs and/or packers. The expandable liner hanger and packer is attached to the expandable liner hanger and packer running tool with a latch. The directional drilling assembly is located at the bottom of the liner with a no-go shoulder and attached to the bottom of the liner with a latch.

Figure 2:
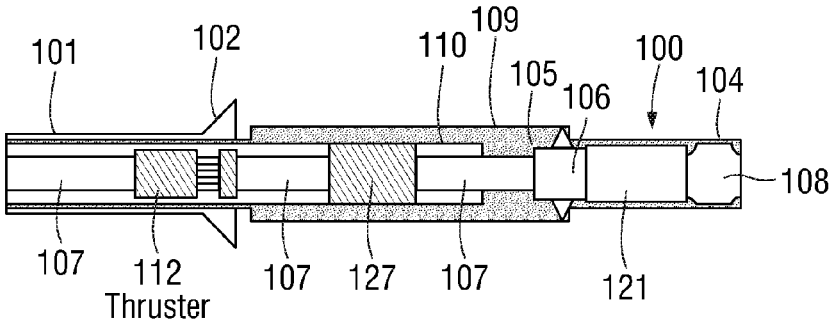
FIG. 2 is a schematic diagram illustrating a directional liner drilling operation according to one or more embodiments of the disclosure.
Figure 3:
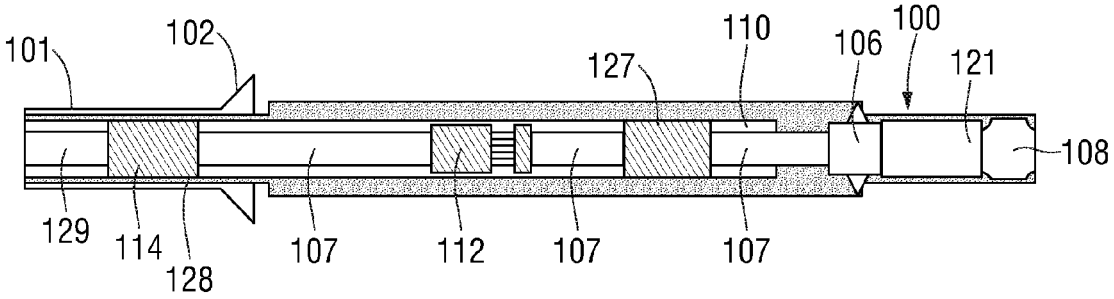
FIG. 3 is a schematic diagram illustrating a directional liner drilling operation according to one or more embodiments of the disclosure.

Reference is now made to FIGS. 1-10, which are cross-sectional views showing a drilling work string or drill string having a bottom-hole assembly ("BHA") 100 in a section of casing 101 and a liner 110, as they would appear at the beginning of directional liner drilling according to an embodiment of the disclosure. As shown in FIG. 1, the BHA 100 may include reamer 106, drill bit 108, and other BHA components 121, such as mud motors, measurement-while-drilling (MWD) or logging-while-drilling (LWD) tools, or other similar tools familiar to those of skill in the art. As FIG. 3 shows, the drilling work string further includes drill pipe 129, which is located above a liner hanger running tool 114 and sections of an inner work string 107. A thruster 112 is mounted on the inner work string 107, which is part of an expandable liner hanger running tool assembly 103 (shown in FIGS. 16A, 16B), that includes the combination of a liner hanger running tool 114 and an expandable liner hanger and packer 128.

In general operation, an operator initially uses the drilling work string to directionally liner drill out of a casing shoe 102, creating a borehole 104. The borehole 104 is typically filled with drilling mud 105. After drilling has advanced far enough out of the casing shoe 102, the reamer 106 is opened to enlarge the borehole 104 as shown in FIG. 2. The borehole 104 should be enlarged to a diameter greater than the diameter of the drill bit 108 and the liner 110. The operator may then continue directionally drilling the borehole through the liner 110, as shown in FIG. 3.

Eventually, however, the demands of drilling through the rock formation are likely to cause the drill bit 108 to become dull or cause the need for other maintenance to be performed on the drill pipe work string. Some maintenance operations may require the drill pipe work string to be removed or "tripped" from the borehole.

Figure 4:
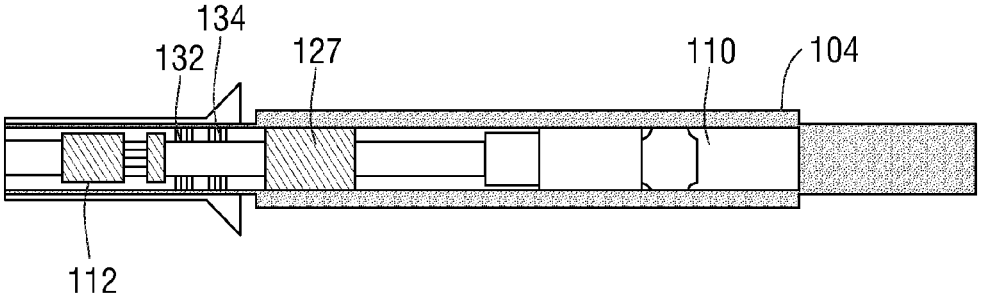
FIG. 4 is a schematic diagram illustrating a directional liner drilling operation according to one or more embodiments of the disclosure.

When the drill pipe work string is to be removed, according to one implementation, the liner 110 may be set on the bottom of the borehole 104 as shown in FIG. 4. After setting the liner 110 on the bottom, release pins may be sheared to allow the liner hanger running tool 114 to disengage from the expandable liner hanger and packer. Other release mechanisms besides the release pins may be used without departing from the scope of the disclosed embodiments. As mentioned above, the liner hanger running tool 114 may be part of an expandable liner hanger running tool assembly 103 that is described in detail in FIGS. 16A-16E. In the embodiment shown in FIGS. 1-10, a fluid seal 127 is provided between the thruster 112 and the BHA 100 to prevent wellbore fluid and formation debris from getting inside the liner 110. Instead, wellbore fluid, or mud 105, should flow from the drill bit 108 back up through the wellbore 104. In another embodiment, particularly useful if the expandable liner hanger running tool assembly 103 is long, the fluid seal 127 may also include one or more latches that operate in a similar manner to the operation of the latches described below in connection with FIGS. 16A-16E and 17.

Figure 16A:
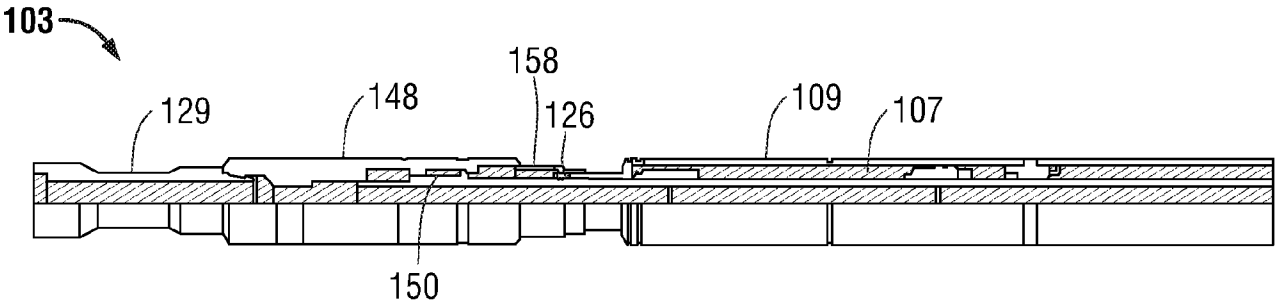
FIGS. 16A-16E are cutaway views of a liner hanger system according to one or more embodiments of the disclosure.
Figure 16B:
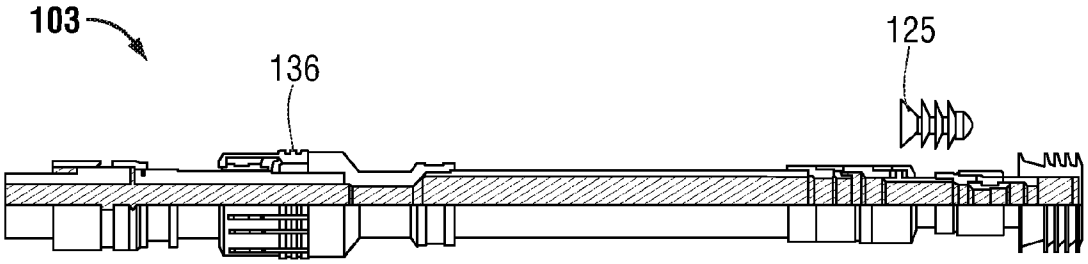
Figure 16C:
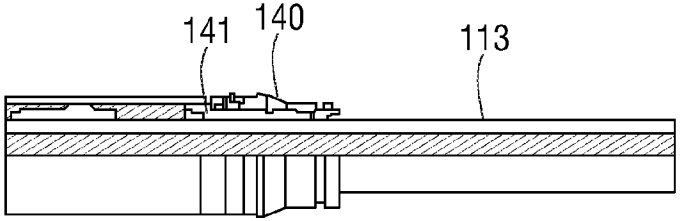

FIGS. 16A-16E show a cutaway view of an expandable liner hanger running tool assembly 103. In FIGS. 16A-16E, the uphole end closest the surface of the assembly is depicted on the left side of the figure, while the downhole end of the assembly is depicted on the right. The expandable liner hanger running tool assembly 103 comprises the inner work string 107 mentioned above and an outer work string 109. Both the inner string 107 and the outer string 109 of the expandable liner hanger running tool assembly 103 may include various components, which will be further described in connection with FIGS. 16A-16E. FIG. 16C shows a cutaway view of a lower section of the expandable liner hanger running tool assembly 103 having an expansion cone 140 and expansion sleeve 141. In some embodiments, this section is arranged downhole of the section shown in FIG. 16A. FIG. 16B shows another section of the expandable liner hanger running tool assembly 103, including a latch 136 for engaging the outer string 109 of the expandable liner hanger running tool assembly 103. The section shown in FIG. 16B may be arranged downhole of the section shown in FIG. 16C.

Figure 16D:
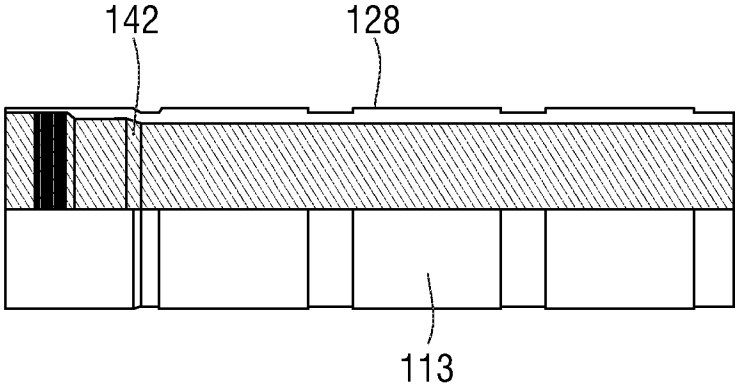

FIG. 16D shows a cutaway view of the expandable liner hanger and packer 128 referenced above. The expandable liner hanger and packer 128 is arranged as a sleeve over inner string mandrel 113, which serves to transfer tensile loads, shown in FIG. 16C, so that the upper end of the expandable liner hanger and packer 128 is immediately downhole of expansion cone 140.

Figure 16E:
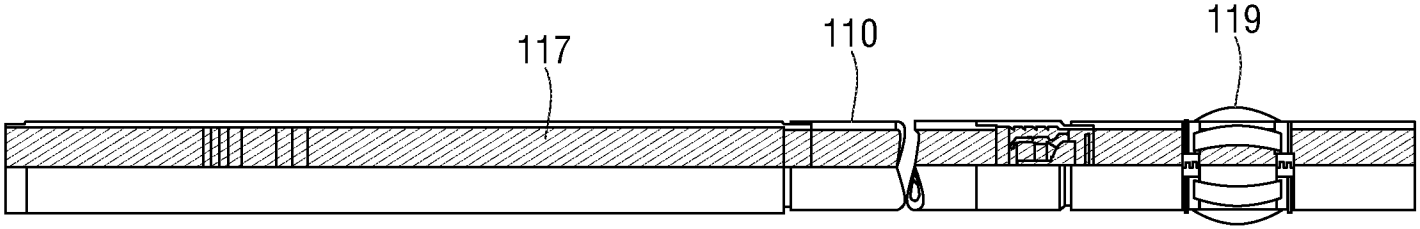

FIG. 16E shows a cutaway view of an outer sleeve section 117 of the expandable liner hanger running tool assembly 103. The outer sleeve section 117 is part of the outer string of expandable liner hanger running tool assembly 103, and includes latch couplings 130, 132, and 134 spaced a predefined distance from each other, which engages the latch 136 on the inner string of the expandable liner hanger running tool assembly 103, shown in FIG. 16B. Outer sleeve section 117 is positioned immediately downhole of the expandable liner hanger and packer 128, shown in FIG. 16D. Liner 110 is attached to the outer sleeve 117, and may include additional components, such as centralizer 119, sliding sleeve subs, packers, etc.

Figure 19:
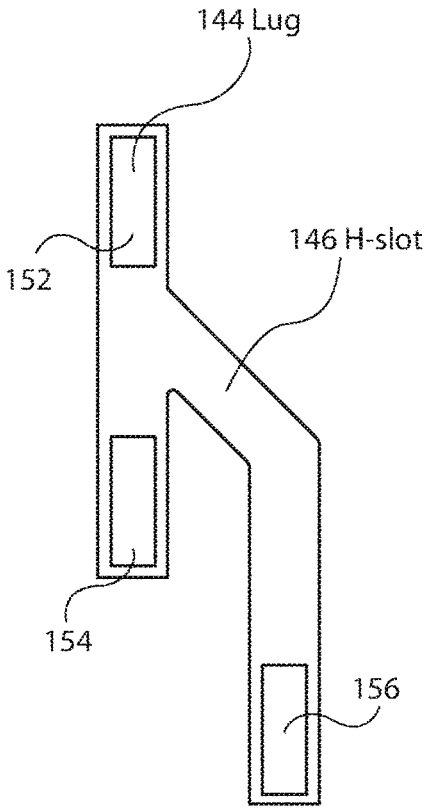
FIG. 19 is a cross-sectional view of a lug arrangement used in a liner hanger system according to one or more embodiments of the disclosure.

FIGS. 16A and 19, illustrate the operation of the release pins according to an embodiment of the disclosure. In this embodiment, release pins 126 are provided in the expandable liner hanger running tool 114 to engage it with the expandable liner hanger and packer. Release pins 126 may be sheared in the expandable liner hanger running tool 114, allowing it to disengage from the expandable liner hanger and packer 128 as shown in FIG. 16A. As shown in FIG. 19, a lug 144 is disposed in a H-slot 146 and is in position 152 when in tension and moves down into position 154 when in compression. Lug 144 is part of lug body 148, as shown in FIG. 16A, which connects to the drill pipe string. H-slot 146 is part of H-slot mandrel 150. Lug 144 can move between position 152 and position 154 without shearing pins 126. To shear pins 126, the drill pipe string is put in tension to put lug 144 into position 152, then the drill pipe string is rotated left, counter clockwise, and next set into compression which moves lug 144 into position 156. The lug body 148 travels downward and contacts shear sleeve 158 and then the shear pins 126 are sheared. Additional downward movement pushes the latch 136 down and out of the lowest latch coupling 134, as shown in FIGS. 16A-16B. This frees the directional liner drilling work string and allows it to be tripped out of, or removed from, the borehole.

Figure 5:
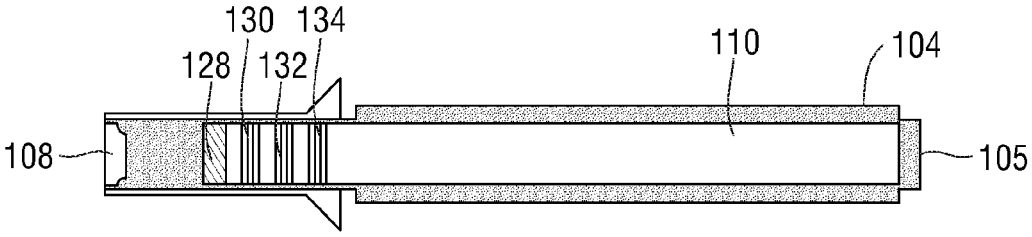
FIG. 5 is a schematic diagram illustrating a directional liner drilling operation according to one or more embodiments of the disclosure.

The drill pipe work string may then be tripped out of the borehole 104, leaving the liner 110 in place as shown in FIG. 5. The liner 110 is attached to expandable liner hanger and packer 128, which includes a plurality of latch couplings 130, 132, and 134 spaced a predefined distance from each other. The drill bit may be replaced, or other operations may be performed on the drill pipe work string at the surface.

It will be recognized that one drawback to removing the drill pipe work string from the bore hole is that a portion of the borehole below the liner may collapse or rock formation cuttings may settle into the bottom of the borehole 104. FIG. 5 shows a cross-section of the borehole with the liner 110 set on the bottom of the borehole 104. Although not expressly shown, a portion of the recently-drilled, but not reamed, borehole 104 may be filled in by cuttings.

Figure 6:
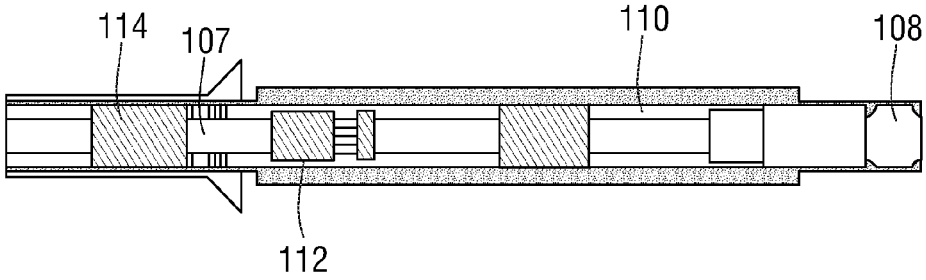
FIG. 6 is a schematic diagram illustrating a directional liner drilling operation according to one or more embodiments of the disclosure.

With reference now to FIG. 6, when the drill pipe work string is run back into the bore hole, the expandable liner hanger running tool 114 is first engaged with the first, or upper, latch coupling 130 of the expandable liner hanger and packer 128.

Once engaged, the liner 110 may then be picked up off the bottom of the borehole 104 and rotated. Drilling fluid is then pumped into the drill pipe work string to activate a thruster 112. The thruster is activated and deactivated with hydraulic pressure through fluid ports. In various embodiments the fluid ports are always open or opened and closed selectively by mud pulse signals, slick line intervention, wire line intervention, etc. The thruster 112 applies force to the drill bit 108, while the downhole motor spins to drill out the portion of the borehole below the liner 110, which may or may not be collapsed. Drilling may be continued until the thruster 112 reaches full stroke, as seen in FIG. 7.

Figure 17:
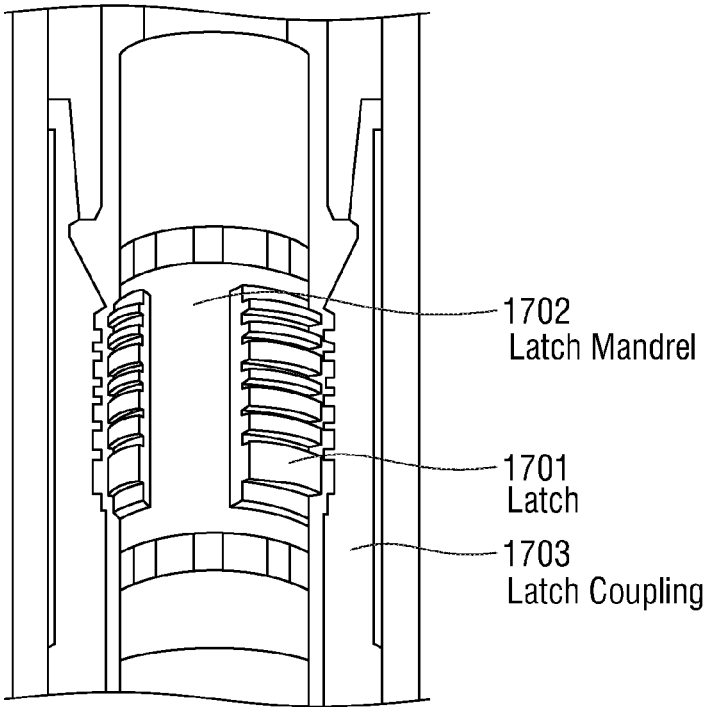
FIG. 17 is a perspective view showing a latch coupling according to one or more embodiments of the disclosure.
Figure 18:
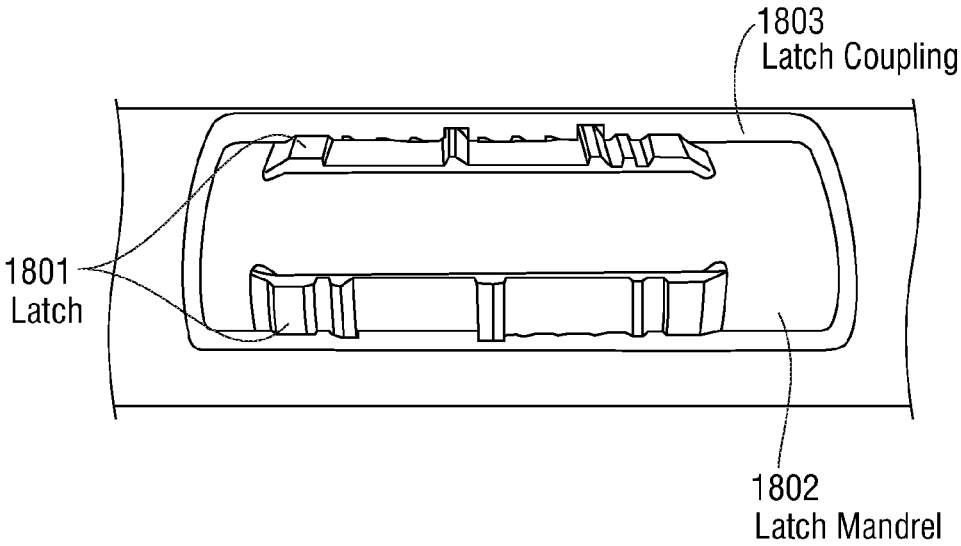
FIG. 18 is a perspective view showing a latch coupling according to one or more embodiments of the disclosure.

FIG. 17 shows a latch coupling according to an embodiment of the disclosure. The latch 1701 includes a series of engagement surfaces that are carried on a latch mandrel 1702. The latch 1701 and latch mandrel 1702 fit within latch coupling 1703. Latch coupling 1703 is provided with a series of engagement grooves that correspond to the engagement surfaces on latch 1701. When the latch 1701 is engaged, the latch engagement surfaces move radially outward to engage with the corresponding latch grooves on latch coupling 1703. FIG. 18 shows a latch coupling according to another implementation of the disclosure. Though the arrangement of the engagement surfaces is different, the latch 1801 similarly is carried on latch mandrel 1802 and engages with grooves provided on latch coupling 1803. Of course, other coupling mechanisms may be used besides the latch coupling shown here without departing from the scope of the disclosed embodiments.

Figure 7:
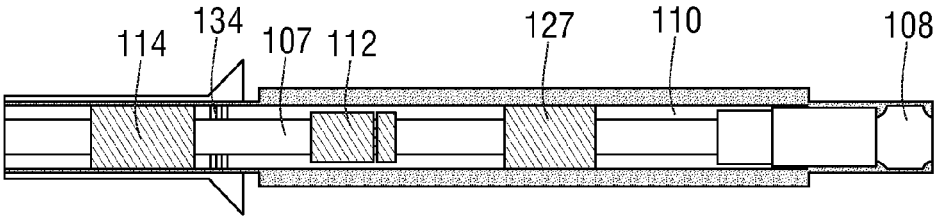
FIG. 7 is a schematic diagram illustrating a directional liner drilling operation according to one or more embodiments of the disclosure.
Figure 8:
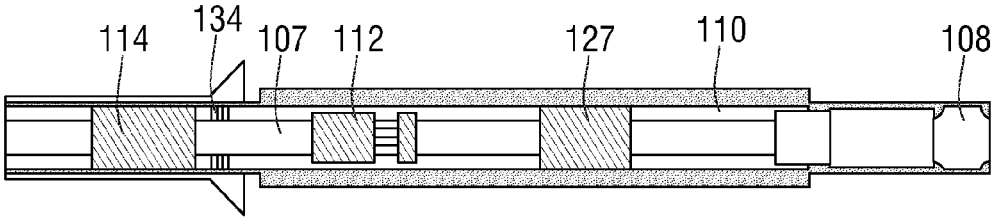
FIG. 8 is a schematic diagram illustrating a directional liner drilling operation according to one or more embodiments of the disclosure.

As shown in FIGS. 6 and 7, after the thruster 112 reaches full stroke with the first latch coupling 130 engaged, the drill pipe work string is then lowered in the borehole until the second latch of the expandable liner hanger running tool 114 engages with the second latch coupling 132. Once the second latch coupling is engaged, then directional liner drilling is resumed using the thruster 112 until it is again at the full stroke, as shown in FIG. 8. This process may be repeated until the expandable liner hanger running tool 114 engages the lowest latch coupling 134 and the expansion cone is against the expandable liner hanger and packer 128.

FIGS. 16C-16D illustrate the operation of the expansion cone in more detail. The expansion cone 140 may be moved downward, toward the bit, through expandable liner hanger and packer 128 until contacting the no-go shoulder 142 inside the expandable liner hanger and packer 128. The portion of the expandable liner hanger and packer 128 above the no-go shoulder 142 is expanded radially outward by the force of the expansion cone 140. The expansion cone 140 and no-go shoulder 142 are conically locked due to sharing the same radial and angular profile.

Figure 9:
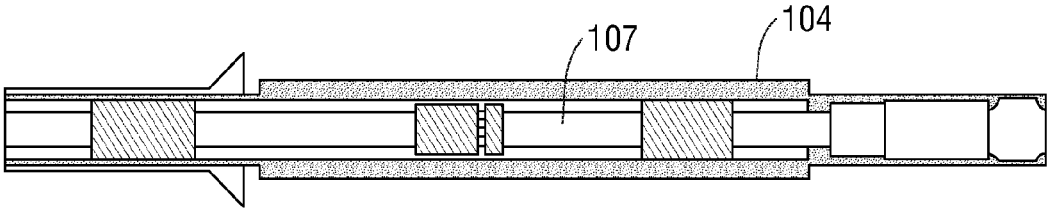
FIG. 9 is a schematic diagram illustrating a directional liner drilling operation according to one or more embodiments of the disclosure.

FIG. 9 is a cross-sectional view of the drill pipe work string positioned in the well bore 104 after the lowest latch coupling is engaged with the expandable liner hanger running tool 114 and the expansion cone is against the liner hanger. Although three latch couplings are depicted in the embodiment shown, the number of latch couplings and spacing may be adjusted based on the length of thruster stroke and length of bottom hole drilling assembly stickout outside of the bottom of the liner.

The liner hanger running tool is now torsionally locked to the liner at the latch and latch coupling interface and will transmit tensile forces from the liner to the drill pipe string through this same latch and latch coupling interface, and will transmit compression forces from the drill pipe string to the liner through the expansion cone and no-go shoulder interface. At this point, the expandable liner hanger running tool 114 would be fully engaged into the expandable liner hanger and packer and directional drilling may continue to total depth.

Once total depth is reached, the liner will be in the correct position for final installation in the borehole. Embodiments of final installation may be applicable to injection wells as well as production wells, including hydrocarbon wells. In various embodiments, the liner may contain sliding sleeve subs and/or packers. The packers may be set mechanically, electronically, or after pumping an activation fluid and allowing the packers to swell. In various embodiments, cementing of the liner, which may or may not contain sliding sleeve subs, may be performed upon reaching total depth with the same directional drilling bottom-hole assembly still in hole. In other embodiments, cementing of the liner may be performed using a different cementing tool string. The expandable liner hanger running tool 114 may then be set down on the bottom of the borehole, and the release pins 126 in expandable liner running tool sheared.

Figure 10:
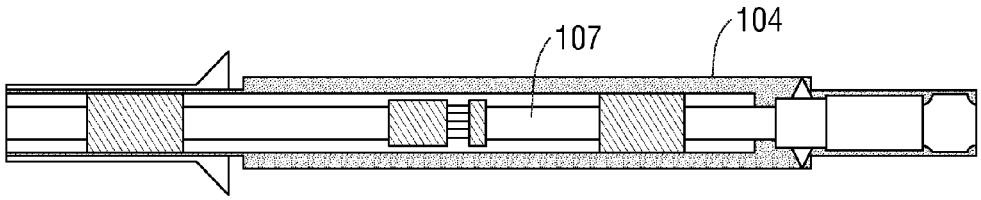
FIG. 10 is a schematic diagram illustrating an operation for directional liner drilling cementing, according to one or more embodiments of the disclosure.
Figure 11:
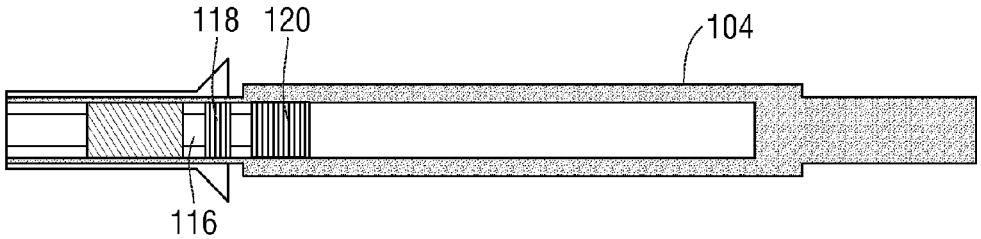
FIG. 11 is a schematic diagram illustrating an operation for directional liner drilling cementing, according to one or more embodiments of the disclosure.
Figure 12:
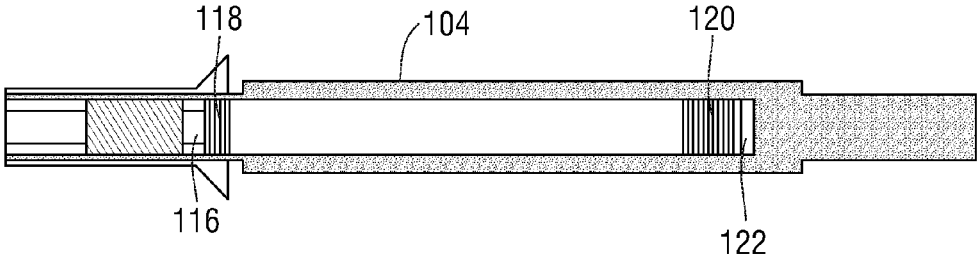
FIG. 12 is a schematic diagram illustrating an operation for directional liner drilling cementing, according to one or more embodiments of the disclosure.

With reference now to FIGS. 10-12, after the work string is out of the borehole 104, the cementing work string is then picked up and tripped into the borehole. FIGS. 11-14 show a cross-sectional view of a borehole with the cementing work string 116 positioned in the borehole 104. In one embodiment of the disclosure, the cementing work string 116 includes the expandable liner hanger and packer running tool, a top liner wiper plug 118, and a pumpable float valve 120. In another embodiment of the disclosure, the cementing work string 116 includes the expandable liner hanger and packer running tool, a top liner wiper plug 118, a bottom wiper plug (not shown), and a pumpable float valve 120. The expandable liner hanger running tool 114 latch then engages the latch coupling in the expandable liner hanger and packer and picks the liner off the bottom of the hole, as shown in FIG. 11. The liner can now be rotated and reciprocated during the cementing operations. A ball or dart is then released at the surface and pumped down the drill pipe until it engages the pumpable float valve 120. This releases the pumpable float valve 120 from the bottom of the liner wiper plug 118. The float valve may then be pumped to the bottom of the liner where it engages a no-go latch shoulder 122. This is best seen in the cross-sectional view of the borehole 104 as shown in FIG. 12. The fluid pressure in the casing string is then increased to firmly seat the float valve in place.

Figure 13:
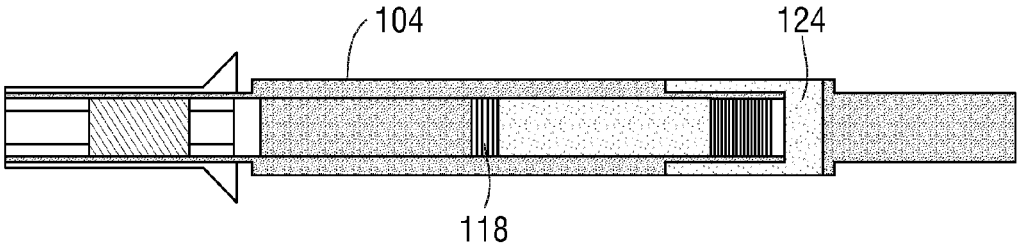
FIG. 13 is a schematic diagram illustrating an operation for directional liner drilling cementing, according to one or more embodiments of the disclosure.
Figure 14:
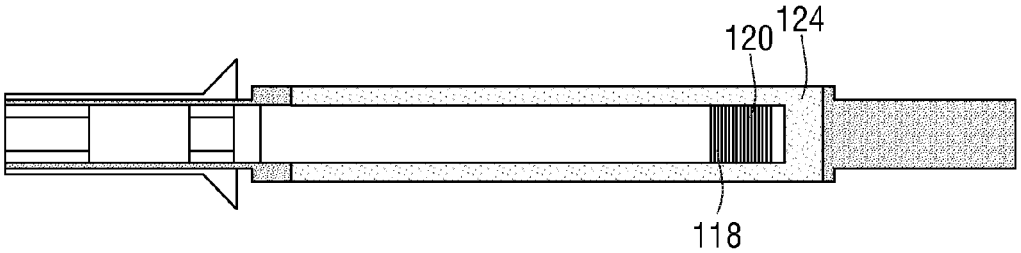
FIG. 14 is a schematic diagram illustrating an operation for directional liner drilling cementing, according to one or more embodiments of the disclosure.
Figure 15:
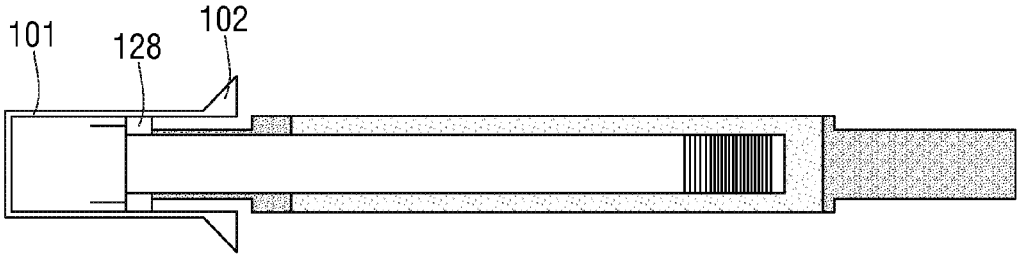
FIG. 15 is a schematic diagram illustrating an operation for directional liner drilling cementing, according to one or more embodiments of the disclosure.

With reference to FIG. 13, pumping of the cement begins and continues until the annulus around the casing in the borehole 104 is sufficiently filled with cement 124. The liner can be rotated and/or reciprocated at this time. A drill pipe dart, such as dart 125 shown in FIG. 16B, may then be released at the surface and pumped down the drill pipe until it engages and releases the top wiper plug 118 from the bottom of the expandable liner hanger running tool 114. With reference to FIG. 14, pumping is continued until the top liner wiper plug 118 engages the top of the pumpable float valve 120. At this point, the cement is fully displaced outside the liner. Next, fluid pressure in the liner string is increased to set and expand the expandable liner hanger and packer. It is often advantageous to perform a pull test at this point to ensure that all steps have gone correctly. Next, the drill pipe weight may be set down to release the expandable liner hanger running tool 114 from the expandable liner hanger. The cementing work string is then tripped out of hole, leaving the liner in place, as shown in FIG. 15, and the well ready for next operational step. This embodiment of the disclosure allows for directional liner drilling and the changing drill bits, or other procedures, without pulling the liner fully back to the surface.

In another embodiment of the disclosure, a method is provided for liner drilling in a wellbore that includes drilling new borehole at the base a casing shoe using a drill pipe work string having a liner coupled to an expandable liner hanger and packer attached to an expandable liner hanger and packer running tool. It may also include reaming at least a portion of the new borehole to enlarge the diameter of the borehole, and setting the liner on the bottom of the reamed portion of the borehole. Release pins may be sheared in the expandable liner hanger running tool 114 to de-couple the expandable liner hanger and packer from the expandable liner hanger running tool 114. The drill pipe work string may then be removed from the borehole, leaving the liner in place. The drill bit may be replaced on the surface, then the drill pipe work string tripped back into the borehole. When the drill pipe work string is tripped back into the borehole, the expandable liner hanger running tool 114 engages a first, or upper, latch coupling to couple the expandable liner hanger running tool with the expandable liner hanger and packer and liner.

In a further embodiment, the disclosure provides a method for liner drilling in a wellbore. The method includes drilling new borehole at the base of a casing shoe using a drill bit attached to the bottom of a drill pipe work string having a liner attached to an expandable liner hanger and packer and coupled to a running tool, reaming at least a portion of the new borehole to enlarge the diameter of the borehole, and setting the liner on the bottom of the reamed portion of the borehole. The method also may include shearing release pins in the expandable liner hanger running tool to de-couple the expandable liner hanger and packer from the expandable liner hanger running tool, then removing the drill pipe work string from the borehole, leaving the liner in place. Next, the method may include returning the drill pipe work string back into the borehole, engaging a latch coupling to couple the expandable liner hanger running tool with the liner, raising the liner off the bottom of the reamed portion of the borehole, and using a thruster to drill into the borehole until the thruster is at full stroke. Once the thruster reaches full stroke, the method may include setting the drill pipe string down until a next latch coupling is engaged between the expandable liner hanger running tool and the expandable liner hanger and packer, and drilling until the thruster is at full stroke.

The previous steps may be repeated until a lowest latch coupling is engaged between the expandable liner hanger running tool and the expandable liner hanger and packer and an expansion cone is against the liner hanger. Liner drilling may continue until target depth is reached.

Figure 20A:
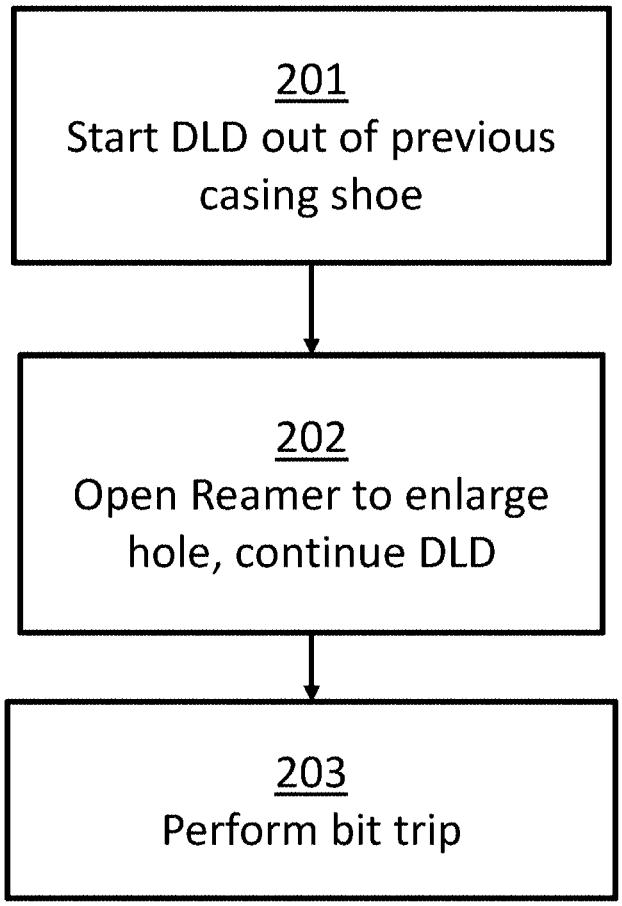
FIGS. 20A-20E are flowcharts illustrating a method for directional liner drilling and cementing according to one or more embodiments of the disclosure.
Figure 20B:
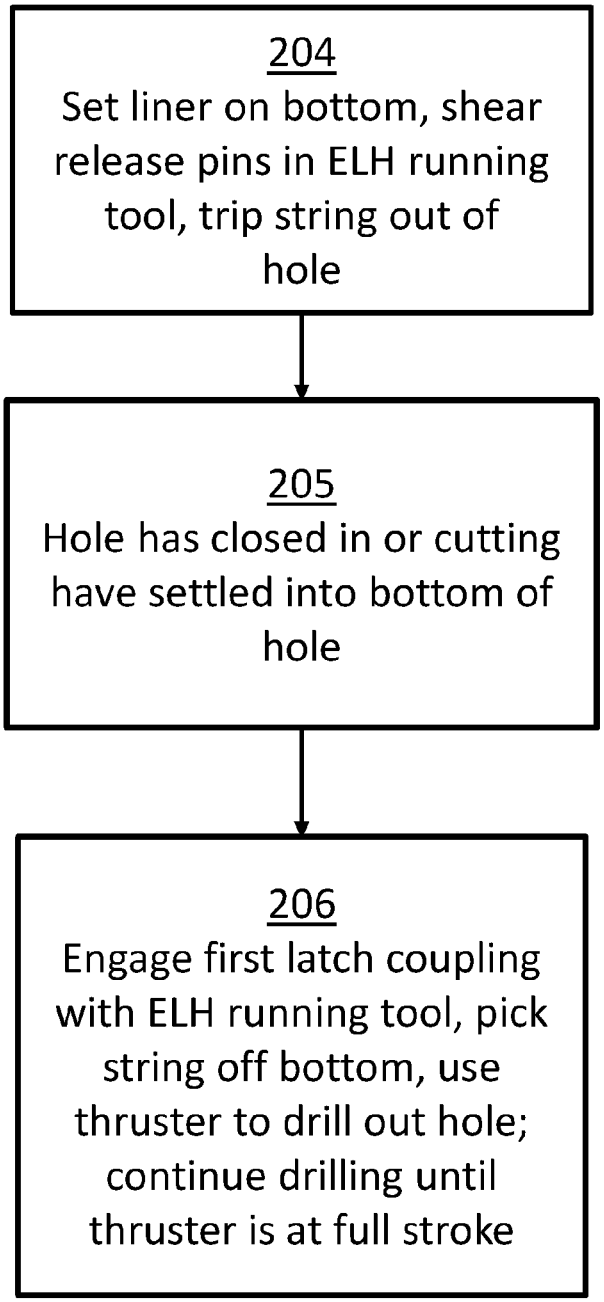
Figure 20C:
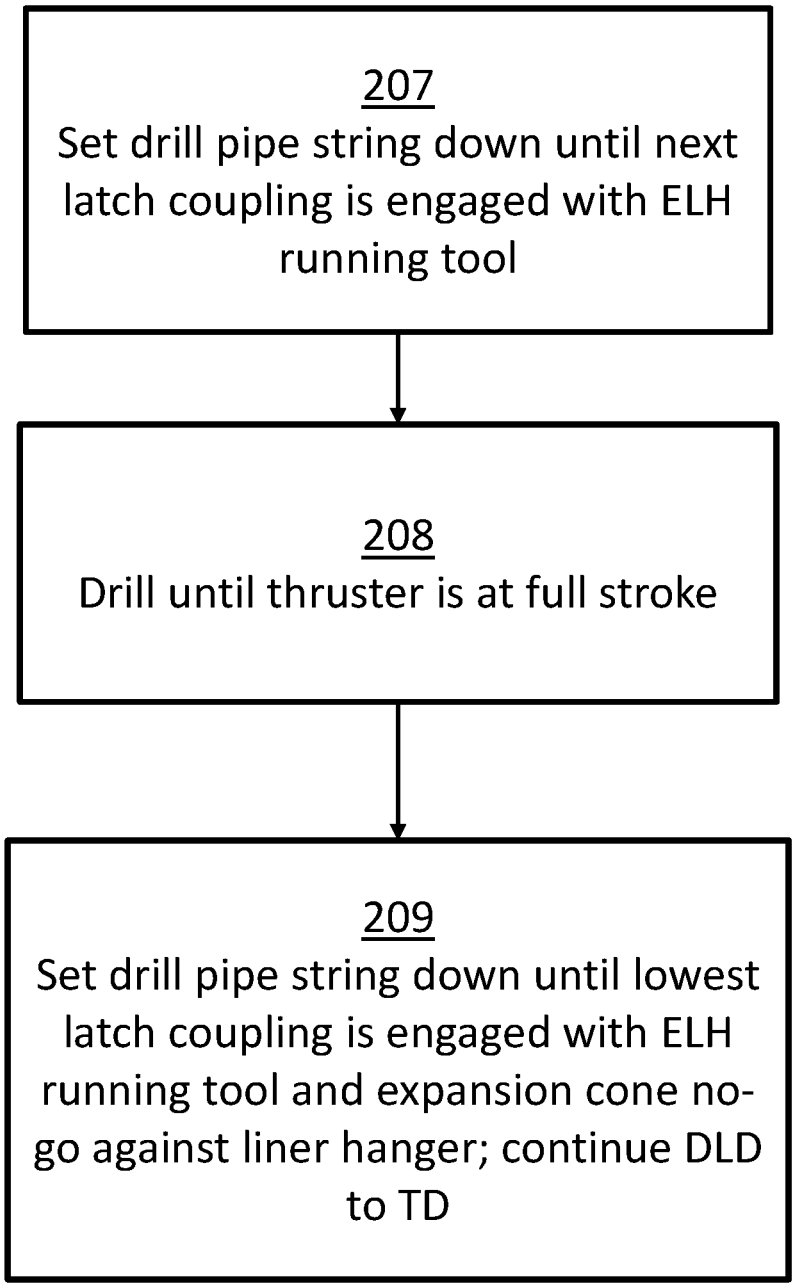

FIGS. 20A-20E are a flow chart illustrating a method for directional liner drilling and cementing according to an embodiment of the disclosure. With reference to FIG. 20A, the method begins with directional liner drilling a new bore hole. In step 201, the method begins by starting the directional liner drill-out of the previous casing shoe. Next, in step 202, the reamer is opened in order to enlarge the hole, and directional liner drilling is continued. After a while, the bit may become dull and need to be replaced. Therefore, in step 203, the operator performs a bit trip to bring the bit out of the hole for replacement. With reference now to FIG. 20B, in step 204, the operator sets the liner on the bottom of the hole, shears the release pins in the running tool, such as the VersaFlex® Expandable Liner Hanger ("ELH") running tool available from Halliburton Energy Services, Inc., and trips the string out of the hole. Next, in step 205, the hole may have closed in or cuttings may have settled into the bottom of the hole. These need to be removed before continuing the next step. Therefore, in step 206, the operator engages the first latch coupling with the ELH running tool, picks the string off the bottom of the hole, and uses the thruster to drill out the hole. The operator may continue to use the thruster to drill out the hole until the thruster reaches full stroke. Referring now to FIG. 20C, in step 207, the operator may set the drill pipe string down until the next latch coupling is engaged with the ELH running tool. In step 208, the operator may drill until the thruster is again at full stroke. In step 209, the operator may set the drill pipe string down until the lowest latch coupling is engaged with the ELH running tool and the expansion cone "no-go" is against the liner hanger. In this configuration, the operator may continue directional liner drilling until total depth is reached.

Figure 20D:
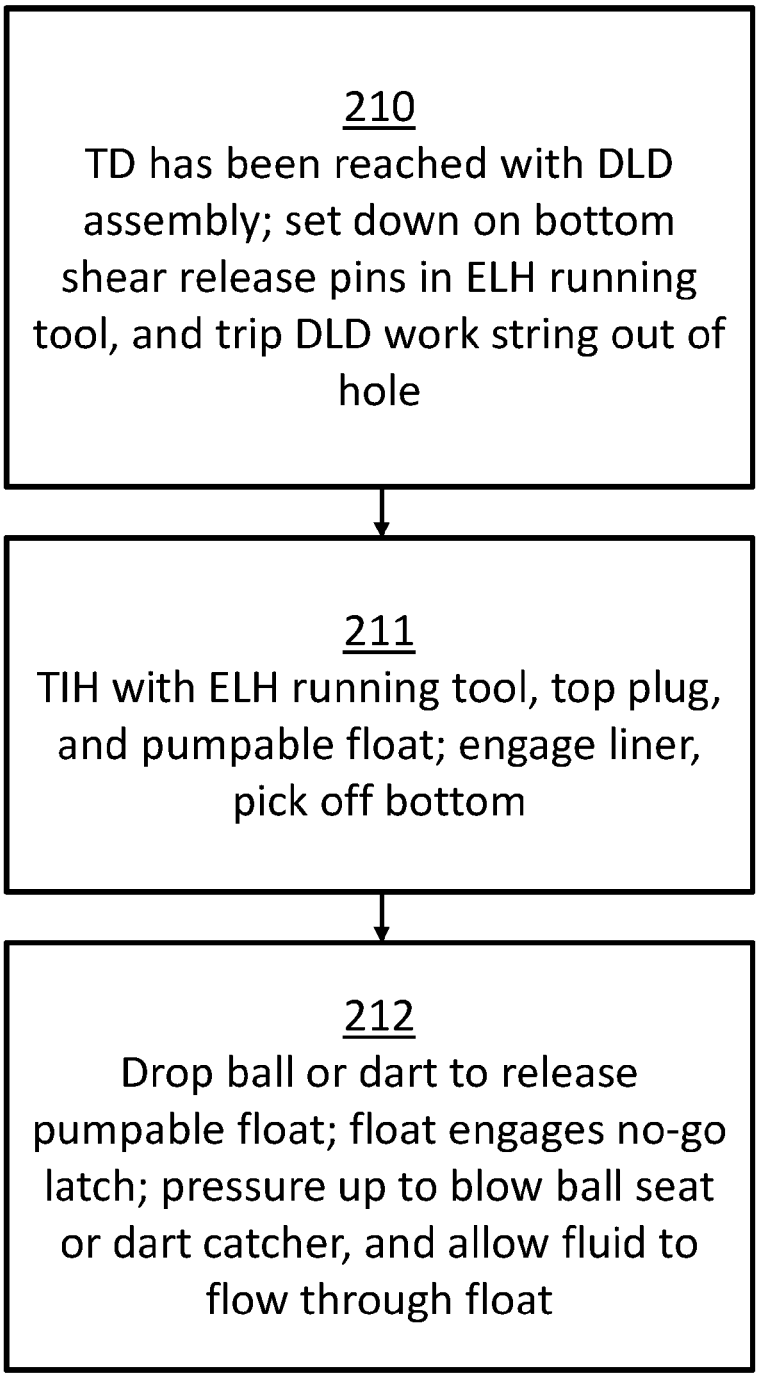
Figure 20E:
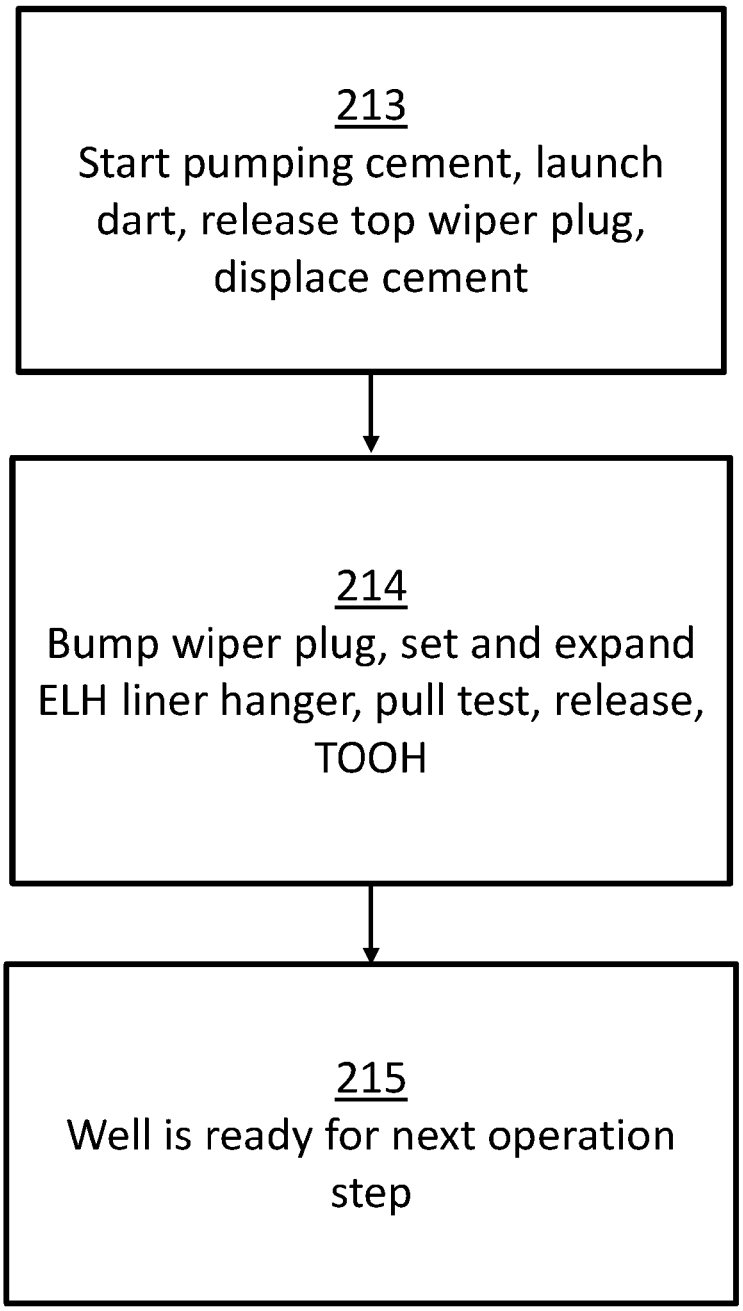

FIG. 20D is a flow chart illustrating a method for directional liner drilling and cementing according to an embodiment of the disclosure. In step 210, total depth has been reached with the directional liner drilling ("DLD") assembly. The assembly is then set down on the bottom shear release pins in the ELH running tool, and the DLD work string is tripped out of the hole. In step 211, the operator may trip-in-hole ("TIH") with the ELH running tool, top plug, and pumpable float. The operator may then engage the liner and pick it off the bottom. In step 212, the operator may drop a ball or dart to release the pumpable float. The float then engages a no-go latch. The operator may then pressure up to open the ball seat or dart catcher and allow fluid to flow through the float. Referring now to FIG. 20E, in step 213, the operator may start pumping cement, launch the dart, release the top wiper plug, and start displacing the cement. Next, in step 214, the operator may bump the wiper plug, set and expand the ELH liner hanger, and perform a pull test and release. If the test is successful, the operator may trip out of hole ("TOOH"). Then, in step 215, the well is ready for the next operation step.

In yet a further embodiment, an apparatus according to the disclosure is conveyed into the hole on a drill pipe. Hanging from the bottom joint of the drill pipe begins an inner and outer string. The inner string is the service string, and the other string is the open hole completion string referred to herein as the liner. The inner service string may start with an expandable liner hanger running and setting tool with drill pipe hanging below it connected to a thruster device, a floating seal and/or lower latch, then a drill pipe dart and burst disk subs and a directional drilling assembly. The outer liner string may start with an expandable liner hanger and packer. Below it may hang latch couplings, with a number of sliding sleeve devices (there might be a number of open hole packers above and below each sliding sleeve device in some embodiments), then a no-go and/or latch collar, and a quick trip valve at the bottom of the liner. For short liners, the apparatus may require only a floating seal on the inner string and a no-go collar at the bottom of the outer string to prevent a fluid flow path in the annulus between the inner diameter of the outer string and the OD of the inner string. For long liners, due to the different torsional properties of the inner string and outer string, a lower latch coupling with seal may be required to prevent any trapped torque from backing off inner or outer string thread connections.

In one implementation, the directional liner drilling assembly may be run in hole, beginning by drilling out the previous casing shoe. Once the drilling bottom-hole assembly has drilled enough hole, the under reamer may activated and the directional well path is drilled and total depth is reached. The under reamer may then be retracted. Circulation may be established at bottom prior to starting the cementing operation.

The cement may be mixed at the surface. The bottom drill pipe wiper dart may then be released from the plug dropping container at surface, and the bottom drill pipe dart may be pumped downhole with cement following it. After all the cement has been pumped, a second top drill pipe wiper dart is released from the plug dropping container at surface, and the cement is pumped and displaced downhole. The bottom drill pipe wiper dart lands in a dart catcher sub, and a rupture disk ruptures, allowing the cement to be pumped and displaced into the annulus between the open hole ID and the outer liner string. Cement displacement continues until the top drill pipe wiper dart lands in a second dart catcher sub. This completes the cementing displacement. Pressure may then be applied down the drill pipe string to set and expand the expandable liner hanger and packer at the top of the liner string.

The drill pipe string is picked up to perform a pull test on the set expandable liner hanger packer, and then slack off weight is applied to the drill pipe to set the expandable liner hanger running and setting tool into compression to decouple the inner string from the outer string at the latch coupling.

The drill pipe string is then picked up, which pulls the entire inner string upward. After the drill bit is pulled inside the liner shoe and above the quick trip valve, the quick trip valve is closed to keep the cement in place and prevent it from flowing back inside the liner. With the quick trip valve closed, pressure may be applied to a second rupture disk at the bottom of the inner string. Forward or reverse circulation can be established at this time, and any excess cement can be pumped out of hole, or the well can be swapped over to completion fluid. A mechanical shifting tool may be run to open the sliding sleeves and allow for hydraulic fracturing operations, or if Remote Open Close Technology (eRED®), available from Halliburton Energy Services, Inc., is implemented, the sleeves may be opened interventionless.

Accordingly, as set forth above, the embodiments disclosed herein may be implemented in a number of ways. In general, in one aspect, the disclosed embodiments relate to a method for liner drilling in a wellbore. The method comprises, among other things, drilling a borehole using a drill pipe work string having a liner attached to a liner hanger on the work string, the liner hanger coupled to a liner hanger running tool on the work string, reaming at least a portion of the borehole to enlarge a diameter of the borehole, and setting the liner in the reamed portion of the borehole. In some embodiments, the liner hanger may be an expandable liner hanger that may also include a packer, and the liner hanger running tool may be an expandable liner hanger running tool. The method additionally comprises de-coupling the liner hanger from the liner hanger running tool, removing the drill pipe work string from the borehole while leaving the liner in place in the reamed portion of the borehole. The drill pipe work string is then returned back into the borehole and the liner hanger running tool is coupled with the liner.

In one or more embodiments, the method for liner drilling may further comprise any one of the following features individually or any two or more of these features in combination: (a) raising the liner in the reamed portion of the borehole, drilling into the borehole a predefined distance, setting the drill pipe string down a preset distance, and repeating the previous steps until a drilling target is reached in the wellbore; (b) cementing the liner in place in the borehole, wherein cementing the liner in place comprises (i) setting the expandable liner on the bottom of the borehole, (ii) de-coupling the liner hanger running tool from the liner hanger, (iii) removing the drill pipe work string out of the borehole, (iv) tripping into the borehole with a work string including a liner hanger running tool, a top plug, and/or a bottom plug, and a pumpable float valve, (v) coupling the liner hanger running tool to the liner hanger and picking the liner off the bottom of the borehole, (vi) releasing the pumpable float valve, pumping cement through the pumpable float valve, and (vii) expanding the liner hanger and tripping the liner hanger running tool out of the borehole; and (c) the liner hanger is coupled with the liner by engaging a latch coupling, the borehole is drilled using a thruster until the thruster is at full stroke, the drill pipe string is set down a preset distance by setting the drill pipe down until a next latch coupling is engaged between the liner hanger running tool and the liner hanger, and drilling until the thruster is at full stroke, and the raising, drilling, and setting steps are repeated until a lowest latch coupling is engaged between the liner hanger running tool and the liner hanger and an expansion cone is against the liner hanger.

In general, in another aspect, the disclosed embodiments relate to a system for liner drilling in a wellbore. The system comprises, among other things, a drill pipe work string including a liner, a liner hanger coupled to a liner hanger running tool, a reamer, and a thruster. As mentioned above, in some embodiments, the liner hanger may be an expandable liner hanger that may also include a packer, and the liner hanger running tool may be an expandable liner hanger running tool. The system additionally comprises release pins in the liner hanger running tool that can be sheared to de-couple the liner hanger and the liner from the liner hanger running tool, wherein the drill pipe work string is removed from the borehole while the liner remains in place. A latch coupling couples the liner hanger running tool to the liner hanger when the drill pipe work string is tripped back into the borehole so the liner drilling can be performed using the thruster until the thruster is at full stroke.

In one or more embodiments, the system for liner drilling in a wellbore may further comprise any one of the following features individually or any two or more of these features in combination: (a) at least one additional latch coupling for coupling the liner hanger running tool to the liner hanger after the drill pipe string is set down so that liner drilling can be performed using the thruster until the thruster is again at full stroke; (c) a lower latch coupling that couples the liner hanger running tool to the liner hanger and an expansion cone is against the liner hanger, allowing directional liner drilling; (c) a drill bit; (d) mud motor; (e) a directional drilling assembly; and (f) a bottom-hole assembly.

In general, in yet another aspect, the disclosed embodiments relate to an apparatus having a retrievable bottom-hole assembly. The apparatus comprises, among other things, a liner hanger coupled to a liner hanger running tool, a reamer, and a thruster. As set forth above, in some embodiments, the liner hanger may be an expandable liner hanger that may also include a packer, and the liner hanger running tool may be an expandable liner hanger running tool. The apparatus additionally comprises a shearable release pin in the liner hanger running tool connecting the liner hanger and liner to the liner hanger running tool allowing the drill pipe work string to be removed from the borehole while the liner remains in place. A latch coupling connects the liner hanger running tool to the liner hanger when the drill pipe work string is tripped back into the borehole.

In one or more embodiments, the apparatus having a retrievable bottom-hole assembly may further comprise any one of the following features individually or any two or more of these features in combination: (a) at least one additional latch coupling for coupling the liner hanger running tool to the liner hanger after the drill pipe string is set down so that liner drilling can be performed using the thruster until the thruster is again at full stroke; (b) a lower latch coupling for coupling the liner hanger running tool to the liner hanger and an expansion cone is against the liner hanger, allowing directional liner drilling; (c) the drill pipe work string is independently removable from the borehole when the shearable release pin disconnects the liner; (d) the thruster performs liner drilling until the thruster is at full stroke; (e) a directional drilling assembly; (f) an H-slot mandrel having an H-slot; and (g) a lug is provided in the H-slot.

In general, in still another aspect, the disclosed embodiments relate to a method of cementing a liner in a borehole. The method comprises, among other things, tripping a drill pipe work string into the borehole, the drill pipe work string including a liner hanger running tool, a top plug, and/or a bottom plug, and a float valve. The method additionally comprises coupling the liner hanger running tool to a liner hanger coupled with the liner, raising the liner in the borehole by a predefined distance, releasing the float valve, and pumping cement through the float valve.

In one or more embodiments, the method of cementing a liner in a borehole may further comprise any one of the following features individually or any two or more of these features in combination: (a) expanding the liner hanger in the borehole and tripping drill pipe work string including the liner hanger running tool out of the borehole; (b) the liner hanger is coupled with the liner by engaging a latch coupling, (c) the liner hanger is an expandable liner hanger, and (d) the liner hanger running tool is an expandable liner hanger running tool.

While the disclosed embodiments have been described with reference to one or more particular implementations, those skilled in the art will recognize that many changes may be made thereto without departing from the spirit and scope of the description. Accordingly, each of these embodiments and obvious variations thereof is contemplated as falling within the spirit and scope of the claimed invention, which is set forth in the following claims.

What is claimed is:

1. A system for liner drilling in a wellbore, comprising:

a drill pipe work string including a liner, a liner hanger coupled to a liner hanger running tool, a reamer, and a thruster;

release pins in the liner hanger running tool that can be sheared to de-couple the liner hanger and the liner from the liner hanger running tool, wherein the drill pipe work string is removed from the borehole while the liner remains in place;

a latch coupling that couples the liner hanger running tool to the liner hanger when the drill pipe work string is tripped back into the borehole so the liner drilling can be performed using the thruster until the thruster is at full stroke; and at least one additional latch coupling for coupling the liner hanger running tool to the liner hanger after the drill pipe string is set down so that liner drilling can be performed using the thruster until the thruster is again at full stroke;

the system further comprising a lower latch coupling that couples the liner hanger running tool to the liner hanger and an expansion cone is against the liner hanger, allowing directional liner drilling.

2. A system for liner drilling in a wellbore as in claim 1, further comprising:

at least one additional latch coupling for coupling the liner hanger running tool to the liner hanger after the drill pipe string is set down so that liner drilling can be performed using the thruster until the thruster is again at full stroke.

3. A system for liner drilling in a wellbore as in claim 1, wherein the liner hanger is an expandable liner hanger, and the liner hanger running tool is an expandable liner hanger running tool.

4. A system for liner drilling in a wellbore as in claim 3, wherein the expandable liner hanger includes a packer.

5. A system for liner drilling in a wellbore as in claim 1, further comprising a directional drilling assembly.

6. A system for liner drilling in a wellbore as in claim 1, further comprising a bottom-hole assembly.

7. An apparatus having a retrievable bottom-hole assembly, comprising:

a latch coupling connecting the liner hanger running tool to the liner hanger when the drill pipe work string is tripped back into the borehole a drill pipe work string including a liner, a liner hanger coupled to a liner hanger running tool, a reamer, and a thruster;

a shearable release pin in the liner hanger running tool connecting the liner hanger and liner to the liner hanger running tool allowing the drill pipe work string to be removed from the borehole while the liner remains in place;

a latch coupling connecting the liner hanger running tool to the liner hanger when the drill pipe work string is tripped back into the borehole; and at least one additional latch coupling for coupling the liner hanger running tool to the liner hanger after the drill pipe string is set down so that liner drilling can be performed using the thruster until the thruster is again at full stroke;

the apparatus further comprising a lower latch coupling for coupling the liner hanger running tool to the liner hanger and an expansion cone is against the liner hanger, allowing directional liner drilling.

8. An apparatus having a retrievable bottom-hole assembly as in claim 7, wherein the drill pipe work string is independently removable from the borehole when the shearable release pin disconnects the liner.

9. An apparatus having a retrievable bottom-hole assembly as in claim 7, further comprising:

at least one additional latch coupling for coupling the liner hanger running tool to the liner hanger after the drill pipe string is set down so that liner drilling can be performed using the thruster until the thruster is again at full stroke.

10. An apparatus having a retrievable bottom-hole assembly as in claim 7, wherein the thruster performs liner drilling until the thruster is at full stroke.

11. An apparatus having a retrievable bottom-hole assembly as in claim 7, further comprising a directional drilling assembly.

12. An apparatus having a retrievable bottom-hole assembly as in claim 7, further comprising an H-slot mandrel having an H-slot.

13. An apparatus having a retrievable bottom-hole assembly as in claim 12, wherein a lug is provided in the H-slot.

* * * * *